United States Patent [19]

Tlapek et al.

[11] Patent Number: 4,913,463

[45] Date of Patent: Apr. 3, 1990

[54] HINGED CASE PROVIDING SECTIONAL COVER WITH ANTI-PINCH INTERLEAVING THROUGH

[75] Inventors: Steve H. Tlapek, Dallas; Patrick P. Hicks, Plano; Julio E. Valella, Dallas, all of Tex.

[73] Assignee: Texas Instruments Incorporated, Dallas, Tex.

[21] Appl. No.: 263,469

[22] Filed: Oct. 27, 1988

[51] Int. Cl.[4] ..... B42D 3/00

[52] U.S. Cl. ..... 281/49; 281/45; 16/355

[58] Field of Search ..... 281/29, 49, 45; 16/355, 16/356; 402/77

[56] References Cited

U.S. PATENT DOCUMENTS 3,359,594 12/1989 Pastoor ..... 16/356

4,307,486 12/1981 Matsumoto ..... 16/355

*Primary Examiner*—Frank T. Yost

*Assistant Examiner*—Tom Hamill Jr.

*Attorney, Agent, or Firm*—William E. Hiller; N. Rhys Merrett; Melvin Sharp

[57] ABSTRACT

Interleaving troughs (28–30) are securely fixed to a front cover (12) and a back cover (14) of a hinged apparatus (10). The first and second troughs (28–30) are generally semicircular in shape and are dimensioned to slidably cooperate with each other. A gap (34) is formed between the second trough (30) and the back cover (14) to receive the first trough (28) when the apparatus (10) is in a fully opened position. When the apparatus (10) is closed, first and second troughs (28–30) form a generally cylindrical container (36) for holding a wire spiral (26) of a book (20). When the apparatus (10) is closed, a void (38) of less than 3/16 inch is formed between the first and second troughs (28–30). The void (38) meets the ASTM standards for toy safety with regard to a pinching hazard.

15 Claims, 1 Drawing Sheet

FIG. 1
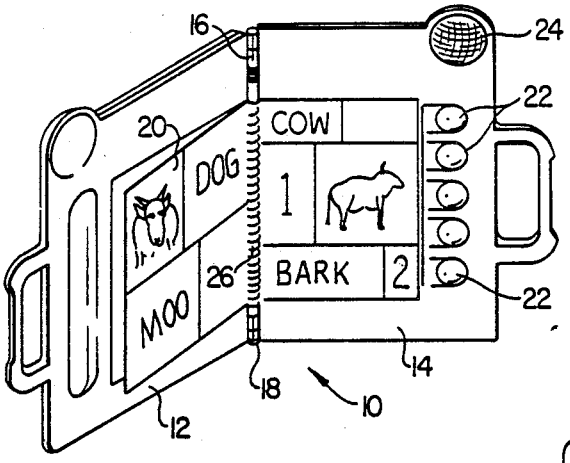
FIG. 2
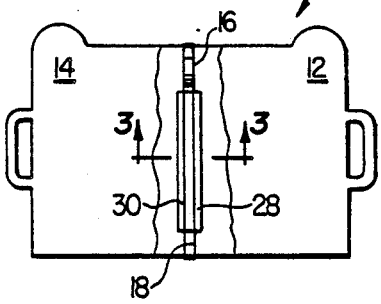
FIG. 3
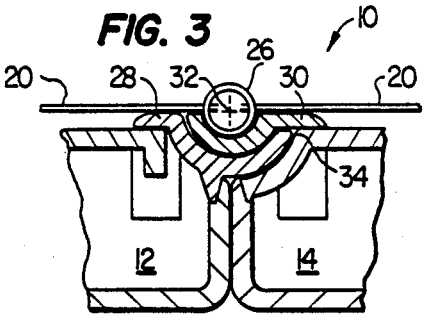
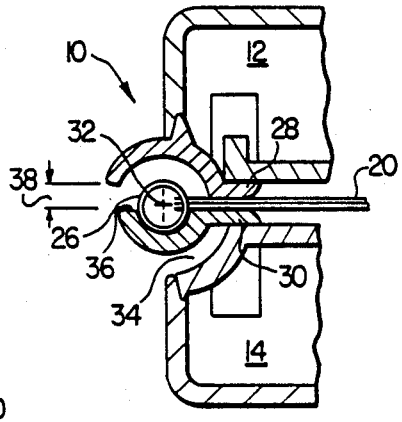
FIG. 5
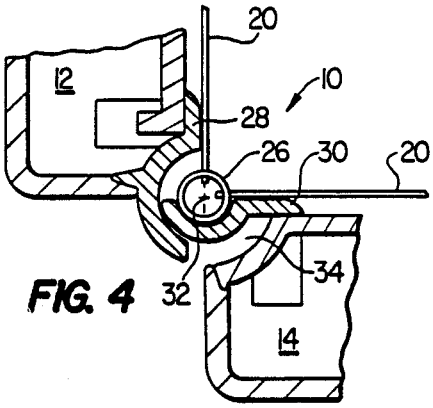
FIG. 4

HINGED CASE PROVIDING SECTIONAL COVER WITH ANTI-PINCH INTERLEAVING THROUGH

TECHNICAL FIELD OF THE INVENTION

This invention relates in general to hinged devices, and in particular to a hinged case providing a sectional cover with an anti-pinch interleaving trough especially applicable for use by children.

BACKGROUND OF THE INVENTION

Devices used by children for play or educational purposes often require the use of hinges for opening and closing the devices. For example, a typical toy might include a hard molded plastic case formed to contain a wire spiral book. The case often has a front cover hinged to a back cover, with each cover containing electronic circuitry to interact with the book to help a child learn to read or solve math problems.

Due to the wire spiral that holds such books' pages together, a gap is generally formed between the front and rear covers of the case to allow the book to be stored in the case when closed and to lay flat when the case is opened. This gap creates a pinching hazard for small children, as fingers may be caught between the front and rear covers when opening or closing the molded plastic case.

The American Society for Testing and Materials (ASTM) has set a safety standard for such gaps in their standard consumer safety specifications on toy safety. According to the ASTM, toys having a gap or clearance along a hinge-line between a stationary portion and a movable portion must have a gap less than 3/16 inch or larger than ½ inch. Thus, there is a need for an apparatus for reducing the likelihood of pinching between two rigid, hinged covers and that meets the ASTM safety standard.

SUMMARY OF THE INVENTION

The present invention disclosed herein comprises an anti-pinch, interleaving trough hinge which substantially reduces or eliminates pinching problems associated with prior hinged devices. The present invention allows rigid front and back covers to be hinged to each other without forming a pinching hazard therebetween.

In accordance with one aspect of the present invention, an anti-pinching device for a hinged apparatus is provided. A first trough is fixed along a first hinged side of the hinged apparatus, and a second trough is fixed along a second hinged side of the hinged apparatus such that the troughs interleave with each other. The first and second troughs share a common centerline with the hinges on the apparatus.

A receptacle is formed by the first and second troughs for receiving a wire spiral when the hinged apparatus is opened or closed. A gap, formed between one of the troughs and its hinged side, is dimensioned to receive the other trough when the hinged apparatus is opened.

It is a technical advantage of the present invention that a pinching hazard is substantially reduced between the rigid front and back covers of a case. It is a further technical advantage that a wire spiral-bound booklet may be placed within the hinge-line of a hard-bound case, allowing the booklet to lay flat when the case is opened.

BRIEF DESCRIPTION OF THE DRAWINGS

For a more complete understanding of the present invention and for further advantages thereof, reference is now made to the following Detailed Description taken in conjunction with the accompanying Drawings, in which:

FIG. 1 is a front isometric view of an educational toy constructed in accordance with the preferred embodiment of the present invention;

FIG. 2 is a rear elevational view of FIG. 1;

FIG. 3 is a cross-sectional view along line 2—2 of FIG. 2 with the case in a fully opened position;

FIG. 4 is a cross-sectional view along line 2—2 of FIG. 2 with the case partially closed; and FIG. 5 is a cross-sectional view along line 2—2 of FIG. 2 with the case in a fully closed position.

DETAILED DESCRIPTION OF THE INVENTION

In FIGS. 1–5, like items are identified by like and corresponding numerals for ease of reference. Referring to FIG. 1, an isometric view of a hinged apparatus is generally identified by the reference numeral 10. The apparatus 10 comprises, for example, an educational toy to help children learn to read. The apparatus 10 has an impact resistant plastic shell comprising a front cover 12 hingedly attached to a back cover 14 by a top hinge 16 and a bottom hinge 18. A pinch opening is formed between the top and bottom hinges 16–18 by the front cover 12 and the back cover 14.

A wire spiral bound book 20 is placed inside the apparatus 10 to allow electronic circuits within the apparatus 10 (not shown) to interact with the book 20. Buttons 22 and a speaker 24 may be provided to allow a child to select options and hear appropriate responses. The wire spiral 26 is positioned between top hinge 16 and bottom hinge 18 to allow the book 20 to lay flat when the apparatus 10 is opened and to fit within the apparatus 10 when closed, as will be subsequently described in greater detail.

Referring to FIG. 2, a rear plan view of the apparatus 10 is illustrated. The front cover 12 is hinged to the back cover 14 by the top hinge 16 and the bottom hinge 18. Attached to the apparatus 10 between the top hinge 16 and the bottom hinge 18 are a first trough 28 and a second trough 30. The troughs 28 and 30 are dimensioned to provide a generally cylindrical container for receiving the wire spiral 26 when the apparatus 10 is closed. The troughs 28 and 30 are also dimensioned to interleave with each other to prevent the formation of a pinching hazard when the apparatus 10 is opened or closed, as will be subsequently described in greater detail.

Referring to FIG. 3, a cross-sectional view along line 2—2 of FIG. 2 is shown with the apparatus 10 in a fully opened position. The first elongated member or trough 28 which is generally semicircular or C-shaped is rigidly fixed to the front cover 12 by any appropriate means such as gluing or molding. The second elongated member or trough 30, also generally semicircular or C-shaped, is likewise secured to the back cover 14. The wire spiral 26 lays within the interleaving troughs 28 and 30 which are constructed and arranged to align with a centerline, as indicated by a cross 32, of the top hinge 16 and the bottom hinge 18, not shown. By aligning the troughs 28–30 with the centerline 32, the book 20 will lie flat against the front cover 12 and the back cover 14 when the apparatus 10 is fully opened.

The second trough 30 is spaced apart from the back cover 14 to form a gap 34 therebetween. The gap 34 is dimensioned to slidably receive the first trough 28 when the apparatus 10 is opened. Thus, the first trough 28 and the second trough 30 are allowed to interleave with each other to prevent interference with the opening and closing of apparatus 10.

Referring to FIG. 4, the apparatus 10 is illustrated in a half-opened or half-closed position. The front cover 12 is in an approximately perpendicular orientation to the back cover 14 which fully exposes the gap 34 formed between second trough 30 and the back cover 14. The curvature of the second trough 30 approximately matches the curvature of the first trough 28 to slidingly cooperate therewith.

Referring to FIG. 5, the apparatus 10 is illustrated in a fully closed position. The front cover 12 is positioned over the back cover 14 with the book 20 fully enclosed therein. The first trough 28 and the second trough 30 now form a generally cylindrical container 36 partially enclosing the wire spiral 26. The cylindrical container 36 allows the book 20 to remain within apparatus 10 when apparatus 10 is closed, without forming a pinching hazard between the front cover 12 and the back cover 14.

A void 38 is created when the apparatus 10 is fully closed between first and second troughs 28–30. The first and second troughs 28–30 are constructed and arranged to make the gap 38 less than 3/16 inch therebetween, which meets the American Society for Testing and Materials (ASTM) standards for toy safety.

In operation, a wire spiral bound book 20 is placed into operating contact with the front cover 12 and the back cover 14 of the hinged apparatus 10. The wire spiral 26 is placed into the generally semicircular shaped first and second troughs 28–30 which lie between the top and bottom hinges 16–18.

As the apparatus 10 is moved from an open position to a closed position, the first trough 28 and the second trough 30 (which are interleaved due to the gap 34 therebetween) slide around each other. When closed, the first and second troughs 28 and 30 form a generally cylindrical container 36 which partially encloses the wire spiral 26. A void 38, formed between the first and second troughs 28–30 when the apparatus 10 is closed, is less than 3/16 inch which meets the ASTM standards for toy safety.

When the apparatus 10 is opened, the void 38 is generally too small to allow a child's finger to be trapped therein. Thus, a pinching hazard which would otherwise exist without troughs 28–30 is eliminated.

Although not shown, it is to be understood that the interleaving troughs could be used with many other types of hinged devices. For example, a hard book cover may form a pinching hazard between the covers thereof. Additionally, hinged containers such as trunks may also find it advantageous to use the interleaving troughs.

Although the present invention has been described with respect to a specific preferred embodiment thereof, various changes and modifications may be suggested to one skilled in the art and it is intended that the present invention encompass such changes and modifications as fall within the scope of the appended claims.

What is claimed is:

1. A book assembly comprising a case providing a sectional cover within which a substantially flat spirally bound book-like object is retained, said book assembly comprising:

a front cover having a first flat inner surface;

a back cover having a second flat inner surface;

said front and back covers having respective marginal edges arranged in juxtaposed relation to each other;

first and second hinge means having a common longitudinal axis and pivotably connecting said front and back covers along said juxtaposed marginal edges thereof to provide for pivoting movement of said front and back covers about said longitudinal axis relative to each other between open and closed positions of said case;

said first and second hinge means being respectively disposed at opposite ends of said juxtaposed marginal edges of said front and back covers and having a longitudinally extending space therebetween along a central portion of said juxtaposed marginal edges of said front and back covers;

a first elongated member along said marginal edge of said front cover proximally related to said back cover and forming a part of said front cover, said first elongated member being disposed in the space between said first and second hinge means and being arcuately curved along its extent to define a first trough;

a second elongated member along said marginal edge of said back cover proximally related to said front cover and forming a part of said back cover, said second elongated member being disposed in the space between said first and second hinge means and being arcuately curved along its extent to define a second trough;

said first and second flat inner surfaces of said front and back covers facing each other with said first and second elongated members having the respective first and second troughs thereof disposed in facing relationship to define a substantially cylindrical cavity between said first and second elongated members and extending in the space between said first and second hinge means in the closed position of the case;

a substantially flat book-like object having at least first and second pages;

spiral binder means connecting said pages of said substantially flat book-like object along a longitudinally extending marginal edge thereof, said spiral binder means being received within said cylindrical cavity between said first and second elongated members with said pages of said book-like object lying between said first and second flat inner surfaces of said front and back covers in the closed position of the case;

one of said first and second elongated members being slidably received within the trough of the other elongated member in overlapped interleaved relationship with respect thereto in response to relative pivoting movement of said front and back covers about said longitudinal axis of said first and second hinge means from the closed position of the case to the open position thereof; and said one elongated member and the other elongated member being disposed in nested relationship with said first and second flat inner surfaces of said front and back covers lying in substantially coplanar relationship and with said spiral binder means of said book-like object lying in the uppermost trough of said elongated members when the case is in its open position;

whereby the respective pages of said book-like object may be turned when the case is in its open position such that successive pages of said book-like object may be disposed in substantially flat relationship as respectively located above said first and second flat inner surfaces of said front and rear covers in a fully exposed state.

2. A book assembly as set forth in claim 1, wherein said one elongated member is said second elongated member forming a part of said back cover, and said other elongated member is said first elongated member forming a part of said front cover.

3. A book assembly as set forth in claim 1, wherein said first and second elongated members are respectively connected to the corresponding marginal edges of said front and back covers to form unitary structures therewith.

4. A book assembly as set forth in claim 1, wherein said first and second elongated members are respectively provided with marginal lips along the extents thereof;

the marginal lips of said first and second elongated members being disposed in opposing spaced relationship defining an elongated gap therebetween when said first and second elongated members are disposed in facing relationship in the closed position of the case; and the widthwise dimension of said elongated gap defined between the opposed marginal lips of said first and second elongated members in the closed position of the case being so restricted in magnitude to substantially prevent pinching of a human finger during relative pivoting movement of said front and back covers between the closed and open positions of the case.

5. A book assembly as set forth in claim 4, wherein the widthwise dimension of said elongated gap defined between the opposed marginal lips of said first and second elongated members in the closed position of the case is less than 3/16th inch.

6. A case providing a sectional cover for a substantially flat object adapted to be retained within the sectional cover, said case comprising:

a front cover having a first flat inner surface;

a back cover having a second flat inner surface;

said front and back covers having respective marginal edges arranged in juxtaposed relation to each other;

hinge means having a longitudinal axis and pivotably connecting said front and back covers along said juxtaposed marginal edges thereof to provide for pivoting movement of said front and back covers about said longitudinal axis relative to each other between open and closed positions of said case;

a first elongated member along said marginal edge of said front cover proximally related to said back cover and forming a part of said front cover, said first elongated member being arcuately curved along its extent to define a first longitudinally extending trough;

a second elongated member along said marginal edge of said back cover proximally related to said front cover and forming a part of said back cover, said second elongated member being arcuately curved along its extent to define a second longitudinally extending trough;

said first and second flat inner surfaces of said front and back covers facing each other with said first and second elongated members having the respective first and second troughs thereof disposed in facing relationship to define a substantially cylindrical cavity between said first and second elongated members in the closed position of the case;

one of said first and second elongated members being slidably received within the trough of the other elongated member in overlapping interleaved relationship with respect thereto in response to relative pivoting movement of said front and back covers about said longitudinal axis of said hinge means from the closed position of the case to the open position thereof; and said one elongated member and the other elongated member being disposed in nested relationship with said first and second flat inner surfaces of said front and back covers lying in substantially coplanar relationship when the case is in its open position.

7. A case as set forth in claim 6, wherein said one elongated member is said second elongated member forming a part of said back cover, and said other elongated member is said first elongated member forming a part of said front cover.

8. A case as set forth in claim 6, wherein said first and second elongated members are respectively connected to the corresponding marginal edges of said front and back covers to form unitary structures therewith.

9. A case as set forth in claim 6, wherein said first and second elongated members are respectively provided with marginal lips along the extents thereof;

the marginal lips of said first and second elongated members being disposed in opposing spaced relationship defining an elongated gap therebetween when said first and second elongated members are disposed in facing relationship in the closed position of the case; and the widthwise dimension of said elongated gap defined between the opposed marginal lips of said first and second elongated members in the closed position of the case being so restricted in magnitude to substantially prevent pinching of a human finger during relative pivoting movement of said front and back covers between the closed and open positions of the case.

10. A case as set forth in claim 9, wherein the widthwise dimension of said elongated gap defined between the opposed marginal lips of said first and second elongated members in the closed position of the case is less than 3/16th inch.

11. A case providing a sectional cover for a substantially flat object adapted to be retained within the sectional cover, said case comprising:

a front cover having a first flat inner surface;

a back cover having a second flat inner surface;

said front and back covers having respective marginal edges arranged in juxtaposed relation to each other;

first and second hinge means having a common longitudinal axis and pivotably connecting said front and back covers along said juxtaposed marginal edges thereof to provide for pivoting movement of said front and back covers about said longitudinal axis relative to each other between open and closed positions of said case;

said first and second hinge means being respectively spaced from each other and located at the opposite ends of the juxtaposed marginal edges of said front and back covers;

a first elongated member along said marginal edge of said back cover proximally related to said front cover and forming a part of said back cover, said second elongated member being disposed in the space between said first and second hinge means and being arcuately curved along its extent to define a second trough;

a second elongated member along said marginal edge of said back cover proximally related to said front cover and forming a part of said back cover, said second elongated member being disposed in the space between said first and second hinge means and being arcuately curved along its extent to define a second trough;

said first and second flat inner surfaces of said front and back covers facing each other with said first and second elongated members having the respective first and second troughs thereof disposed in facing relationship to define a substantially cylindrical cavity between said first and second elongated members and extending in the space between said first and second hinge means in the closed position of the case;

one of said first and second elongated members being slidably received within the trough of the other elongated member in overlapped interleaved relationship with respect thereto in response to relative pivoting movement of said front and back covers about said longitudinal axis of said first and second hinge means from the closed position of the case to the open position thereof; and said one elongated member and the other elongated member being disposed in nested relationship with said first and second flat inner surfaces of said front and back covers lying in substantially coplanar relationship when the case is in its open position.

12. A case as set forth in claim 11, wherein said one elongated member is said second elongated member forming a part of said back cover, and said other elongated member is said first elongated member forming a part of said front cover.

13. A case as set forth in claim 11, wherein said first and second elongated members are respectively connected to the corresponding marginal edges of said front and back covers to form unitary structures therewith.

14. A case as set forth in claim 11, wherein said first and second elongated members are respectively provided with marginal lips along the extents thereof;

the marginal lips of said first and second elongated members being disposed in opposing spaced relationship defining an elongated gap therebetween when said first and second elongated members are disposed in facing relationship in the closed position of the case; and the widthwise dimension of said elongated gap defined between the opposed marginal lips of said first and second elongated members in the closed position of the case being so restricted in magnitude to substantially prevent pinching of a human finger during relative pivoting movement of said front and back covers between the closed and open positions of the case.

15. A case as set forth in claim 14, wherein the widthwise dimension of said elongated gap defined between the opposed marginal lips of said first and second elongated members in the closed position of the case is less than 3/16th inch.

* * * * *